US008783176B2

(12) United States Patent
Cziraky et al.

(10) Patent No.: US 8,783,176 B2
(45) **Date of Patent: *Jul. 22, 2014**

(54) SELF-SEALING STAMPING DEVICE

(71) Applicant: Crayola LLC, Easton, PA (US)

(72) Inventors: David A. Cziraky, Bethlehem, PA (US); Christopher P. Orem, Easton, PA (US)

(73) Assignee: Crayola LLC, Easton, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/775,410

(22) Filed: Feb. 25, 2013

(65) Prior Publication Data

US 2013/0160664 A1 Jun. 27, 2013

Related U.S. Application Data

(63) Continuation-in-part of application No. 12/688,211, filed on Jan. 15, 2010, now Pat. No. 8,387,528.

(60) Provisional application No. 61/144,949, filed on Jan. 15, 2009.

(51) Int. Cl.

| | |
|---|---|
| ***B41K 1/40*** | (2006.01) |
| ***B41K 1/42*** | (2006.01) |
| ***B41K 1/54*** | (2006.01) |
| ***B41K 1/36*** | (2006.01) |

(52) U.S. Cl.

CPC .... *B41K 1/36* (2013.01); *B41K 1/54* (2013.01)
USPC ..... 101/333; 101/334

(58) Field of Classification Search

CPC ..... B41K 1/02; B41K 1/36; B41K 1/38; B41K 1/40; B41K 1/42; B41K 1/54; B41K 1/56
USPC ..... 101/327, 333, 334, 405, 406, 103, 104
See application file for complete search history.

(56) References Cited

U.S. PATENT DOCUMENTS

| | | | | |
|---|---|---|---|---|
| 2,079,080 | A * | 5/1937 | Melind | 101/334 |
| 3,779,164 | A * | 12/1973 | Study | 101/334 |
| 5,114,788 | A * | 5/1992 | Nakagawa et al. | 442/77 |

FOREIGN PATENT DOCUMENTS

JP 02311561 A * 12/1990

* cited by examiner

*Primary Examiner* — Leslie J Evanisko
(74) *Attorney, Agent, or Firm* — Shook, Hardy & Bacon L.L.P.

(57) ABSTRACT

A self-sealing stamping device suitable for use with non-alcohol based inks is described. The stamping device includes an applicator that has raised features for providing a stamped design. The applicator also includes sealing features that mate with sealing features on an inkpad housing to provide one or more airtight seals therebetween. The inkpad housing provides an enclosure for an inkpad with one or more apertures. Sealing features are provided circumscribing the apertures for mating with sealing features of the applicator. In a closed position, the stamping device provides an airtight enclosure for the inkpad comprised of the inkpad housing and the applicator.

19 Claims, 5 Drawing Sheets

SELF-SEALING STAMPING DEVICE

CROSS-REFERENCE TO RELATED APPLICATIONS

This Application is a continuation-in-part of U.S. Pat. No. 8,387,528, filed Jan. 15, 2010, entitled "Self-Sealing Stamping Device," which claims priority to U.S. Provisional Patent Application Ser. No. 61/144,949, filed Jan. 15, 2009, the disclosure of both of which are hereby incorporated by reference in their entirety.

SUMMARY

In an embodiment of the invention a self-sealing stamping device useable with non-alcohol based inks is described. The self-sealing stamping device is described having an applicator with raised features forming stamping surfaces. An inkpad housing including an inkpad disposed therein is provided. The inkpad housing has apertures on a top surface having a perimeter similar to that of the raised features of the applicator. An airtight bond is formed between the top surface of the inkpad housing and the applicator. A mechanism for rotatably actuating the applicator from a closed position facing and contacting the inkpad cover to a stamping position facing and contacting a surface to be stamped is described. The contact surfaces between the applicator and the inkpad housing provide an airtight seal, thereby enclosing the inkpad within an airtight chamber.

This Summary was provided to introduce a selection of concepts in a simplified form that are further described below in the Detailed Description. This Summary is not intended to identify key features or essential features of the claimed subject matter, nor is it intended to be used in isolation as an aid in determining the scope of the claimed subject matter.

BRIEF DESCRIPTION OF THE DRAWING

Illustrative embodiments of the invention are described in detail below with reference to the attached drawing figures, wherein.

DETAILED DESCRIPTION

Figure 1:
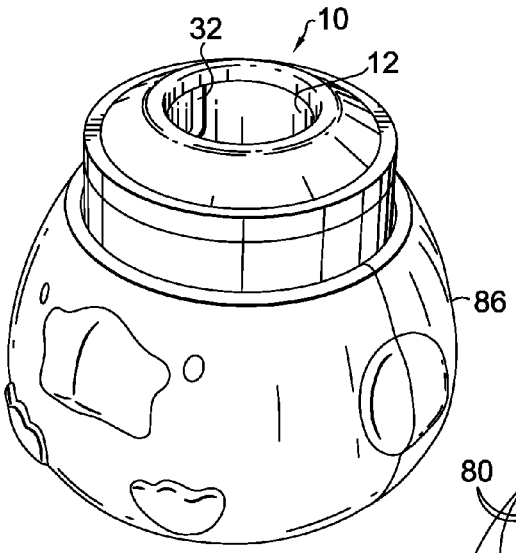
FIG. 1 is a perspective view depicting a self-sealing stamping device in a closed position within an outer housing in accordance with an embodiment of the invention.

The subject matter of embodiments of the invention is described with specificity herein to meet statutory requirements. However, the description itself is not intended to limit the scope of this patent. Rather, the inventors have contemplated that the claimed subject matter might also be embodied in other ways, to include different components, steps, or combinations thereof similar to the ones described in this document, in conjunction with other present or future technologies. Moreover, although terms such as "step" and/or "block" may be used herein to connote different elements of methods employed, the terms should not be interpreted as implying any particular order among or between various steps herein disclosed unless and except when the order of individual steps is explicitly described.

Embodiments of the invention describe a self-sealing, self-inking stamping device. In one aspect, the stamping device provides an airtight ink reservoir chamber when in a closed position. In another aspect, the stamping device is useable with non-alcohol based, water-based, non-toxic, and washable inks that may be suitable for use by small children, such as children two years of age and older. In an embodiment, a self-sealing stamping device is described. The stamping device includes an applicator having raised features on a stamping surface for transferring an ink to a marking surface. The stamping device also includes an inkpad housing having an aperture with a perimeter operably configured to receive the stamping surface of the applicator. An airtight seal is formed between the inkpad housing and the applicator when the stamping device is in a closed position. A mechanism is also included for rotatably actuating the applicator from the closed position facing and contacting the inkpad housing to a stamping position facing and contacting the marking surface.

In another embodiment, a method for providing a self-sealing stamping device is described. An applicator having one or more raised features on a stamping surface is provided. An inkpad housing having an ink source disposed therein is also provided. The inkpad housing has an aperture suitable for accepting the stamping surface of the applicator. An airtight seal is formed between contacting surfaces of the inkpad housing and the applicator when the stamping device is in a closed position. The stamping surface of the applicator is inserted into the aperture of the inkpad housing. The raised features on the stamping surface contact the ink source. The inkpad housing is contacted by the applicator to form an airtight seal between the applicator and the inkpad housing.

In another embodiment, a self-sealing stamping device is described. The stamping device includes an applicator, an inkpad housing, an ink source, and a mechanism. The applicator has raised features on a stamping surface for transferring an ink to a marking surface and a sealing feature around the perimeter of the stamping surface that includes a rib, a flange, a trough, and/or a channel. The inkpad housing has an aperture with a perimeter operably configured to receive the stamping surface of the applicator, and a sealing feature around the perimeter of the aperture comprising a rib, a flange, a trough, and/or a channel. The airtight seal is formed between mating sealing features of the inkpad housing and the applicator when the stamping device is in a closed position. The ink source is disposed within the inkpad housing and includes a cloth pad, a foam pad, a cloth pad with an associated ink reservoir, or a foam pad with an associated ink reservoir. The ink source contains an ink that is non-toxic, washable, water-based, and/or alcohol-based. The mechanism allows for rotatably actuating the applicator from the closed position facing and contacting the inkpad housing to a stamping position facing and contacting the marking surface.

With reference now to the FIGS. 1-9, a self-sealing, self-inking stamping device 10 is described according to an embodiment of the invention. The stamping device 10 comprises an upper housing 12, a lower housing 14, an inkpad housing 16, a spring 18, and an applicator 20. The components of the stamping device are constructed from any material including for example, and not limitation, plastics, metals, rubbers, composites, and ceramics. The construction is completed by any method known in the art suitable for use with the selected materials and component design. In an embodiment, one or more components are constructed from injection molded acrylonitrile butadiene styrene (ABS) plastic or polypropylene plastic.

The upper housing 12 is generally cylindrical in shape, but may have any desired cross-sectional shape suitable for implementations of the stamping device 10. For example, as best depicted in FIGS. 4, 7, 8, and 9, the upper housing 12 has a cross-sectional shape resembling that of a circle with two opposite sides truncated or flattened.

The cross-sectional shape of the upper housing 12 is compatible with the cross-sectional shape of the lower housing 14 and is configured to be received between a pair of actuator arms 22 that form the sides of the lower housing 14. Further, the upper housing 12 has any dimensions desirable and compatible with applications of stamping device 10. The upper housing may also include one or more features 24 to allow the inkpad housing 16 to be affixed thereto, as described below.

The upper housing 12 includes a pair of flanges 26 extending from opposite sides of a flattened portion 28 along each side of the upper housing 12. The flanges 26 extend parallel to the length of the upper housing 12 and form sides of a slot 30 within which an actuator arm 22 is disposed on each side of the upper housing 12. In another embodiment, one or more channels are integrated along the perimeter of the upper housing 12 extending parallel to the length of the housing for slideably coupling to the actuator arms 22 of the lower housing 14.

A pair of non-linear slots 32 is disposed along the flattened portions 28 of the upper housing 12. The slots 32 extend from an upper edge 34 toward the opposite end of the upper housing 12 along a portion of the length of the upper housing 12. The path of the slots 32 provides a first straight segment 36, a rotating segment 38, and a second straight segment 40 (shown in FIG. 9). The first and second straight segments 36 and 40 are aligned and are separated from one another by the rotating segment 38. The rotating segment 38 deviates from the path of the first and second straight segments 36 and 40 to form an arced path therebetween.

Within the interior of the upper housing 12 extend a pair of stationary pins 42. Each of the stationary pins 42 extend from an interior wall of the upper housing 12 from a point that is generally central to the arc of the rotating segment 38 of the slot 32. The stationary pins 42 extend from opposite sides toward one another a sufficient distance to engage a carrier 44 as described below.

The lower housing 14 includes the pair of actuator arms 22 extending from a base portion 46 for slideably coupling to the upper housing 12, as described above. The base portion 46 is a generally flat section with one or more flanges or other features extending therefrom and provides a closed end for supporting a first end 48 of the spring 18. In another embodiment, one or more cross members traversing are alternatively employed for supporting the spring 18. The base portion 46 may also include a raised feature 50 extending from the surface thereof to engage the first end 48 of the spring 18 and thereby restrict lateral movement of the spring 18.

The actuator arms 22 extend a sufficient distance from the base portion 46 to engage a pair of pins 52 extending from opposite sides of the carrier 44 as described more fully below and to provide sufficient separation between the base portion 46 and the upper housing 12 to allow actuation of the carrier 44 and spring 18 also as described below. An aperture 54 is included near the distal ends of the actuator arms 22 through which the pair of pins 52 are inserted. The apertures 54 are elongated laterally or perpendicularly to the length of the actuator arms 22 to allow the pins 52 to move laterally within the apertures 54.

The inkpad housing 16 provides an enclosure for an inkpad 56 that is fully enclosed and sealed except for one or more apertures 58 through which the inkpad 56 is exposed. The inkpad housing 16 has dimensions and features suitable for engaging a lower end 60 of the upper housing 12 such that the inkpad housing 16 is at least partially disposed within the lower end 60 of the upper housing 12. The inkpad housing 16 may also include one or more features 62 for affixing the inkpad housing 16 to the upper housing 12 with one or more fasteners (not shown). In another embodiment, the inkpad housing is affixed to the upper housing with one or more glues, adhesives, or bonding techniques. The inkpad housing 16 also includes a base 64 against which the spring 18 is contacted. The base 64 may include one or more features 66 thereon for engaging a second end 68 of the spring 18 and restricting lateral movement thereof.

Figure 5:
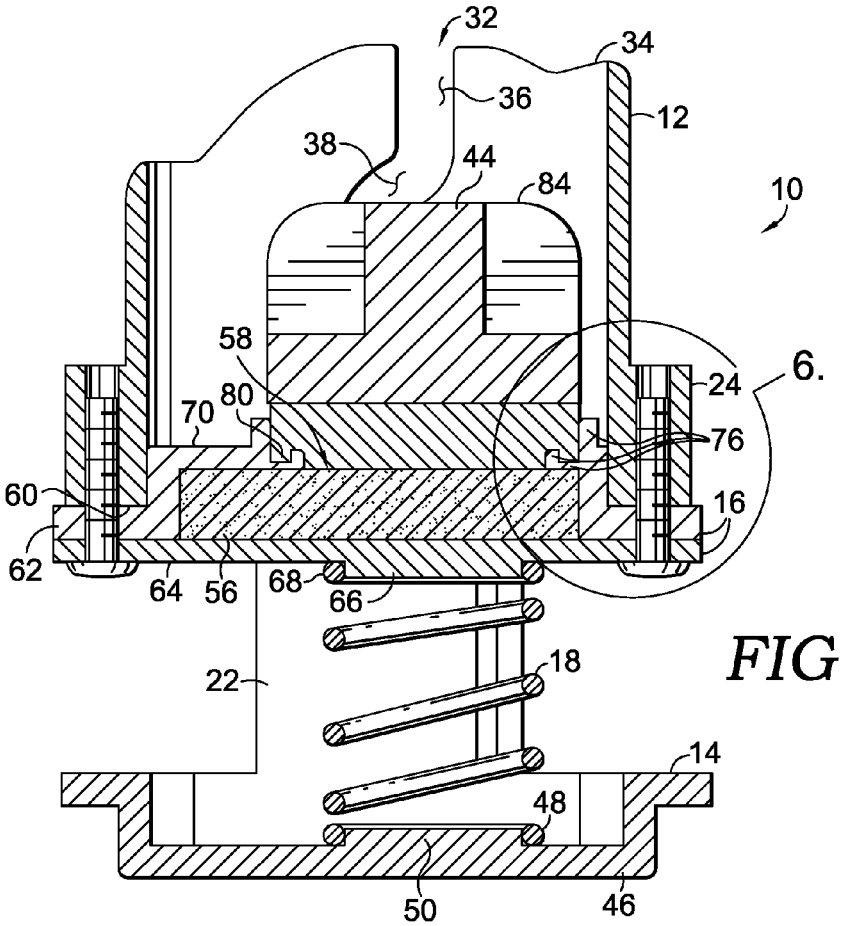
FIG. 5 is a cross-sectional view depicting a self-sealing stamping device in accordance with an embodiment of the invention.
Figure 6:
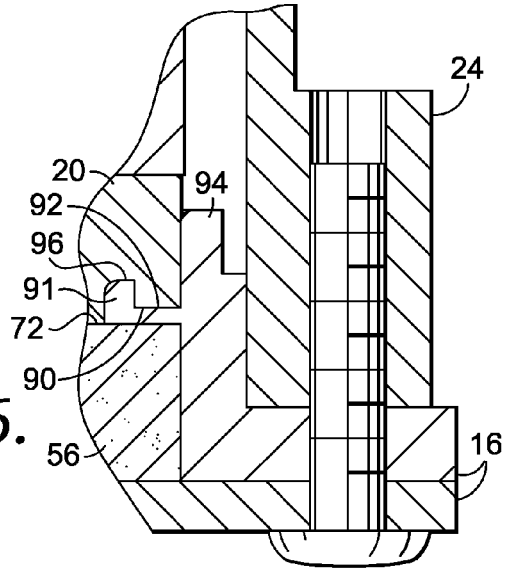
FIG. 6 is an enlarged view of the region 6 of the self-sealing stamping device depicted in FIG. 5.
Figure 7:
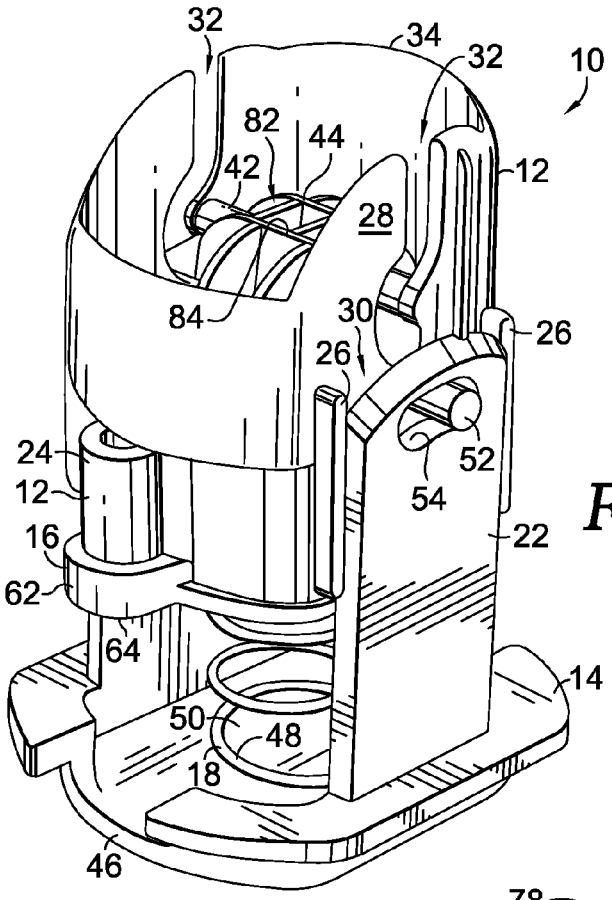
FIG. 7 is a perspective view depicting a self-sealing stamping device in a closed position in accordance with an embodiment of the invention.

A top surface 70 of the inkpad housing 16 has the one or more apertures 58 in an interior portion of the surface through which an inking surface 72 of the inkpad 56 is exposed. The shape of the apertures 58 is similar to, or mimics that of the perimeter of one or more raised features 74 of the applicator 20 such that the raised features 74 may be inserted within the apertures 58 when the stamping device 10 is in a closed position, as depicted in FIGS. 5 and 6. In an embodiment, the apertures 58 are sized and configured such that an airtight seal is created when the raised features 74 are inserted therein. In another embodiment, one or more raised or depressed sealing features 76 are included around the perimeter of the apertures 58 and/or along the top surface 70 to aid in creating the airtight seal. In further embodiments, at least a portion of the inkpad housing 16 and/or the applicator 20 is made from polyurethane material, such as a chitin-based polyurethane. Accordingly, in some embodiments, a chitin-based polyurethane material surrounds a perimeter of the apertures 58, the sealing features 76, the stamping surface 78, and/or the raised features 74, to aid in creating the airtight seal. In further embodiments, one or more components of the stamping device 10 are made of a polyurethane material, such as a chitin-based polyurethane material. For example, the applicator 20, stamping surface 78 and/or raised features 74 may be made from a polyurethane material to assist in providing a sealed, airtight inkpad housing 16 while the stamping device 10 is in a closed position.

The inkpad 56 is comprised of any available inkpad technology including, for instance, saturated or wetted cloth or foam pads and cloth or foam pads with ink reservoirs. In an embodiment, the inkpad 56 is a cloth pad saturated with a water-based, non-toxic, washable ink. Other alcohol-based, non-alcohol-based, and water-based inks are also useable in embodiments of the invention. As used herein, "ink" is understood to be inclusive of inks, dyes, and other liquid, paste, or powder-based marking materials, solutions, suspensions, and the like. The inkpad 56 may be mounted on a backing to provide additional rigidity or support, among other benefits.

The spring 18 is any spring suitable for use in stamping device 10. In an embodiment, the spring 18 is a steel coil compression spring exerting a force capable of slideably biasing the upper housing 12 away from the base portion 46 of the lower housing 14. The spring 18 is disposed between the base portion 46 of the lower housing 14 and the base 64 of the inkpad housing 16.

Figure 2:
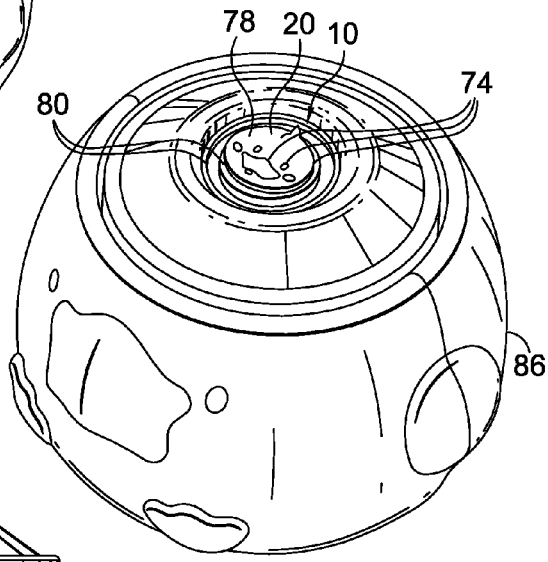
FIG. 2 is a perspective view depicting a self-sealing stamping device in a stamping position within an outer housing in accordance with an embodiment of the invention.
Figure 3:
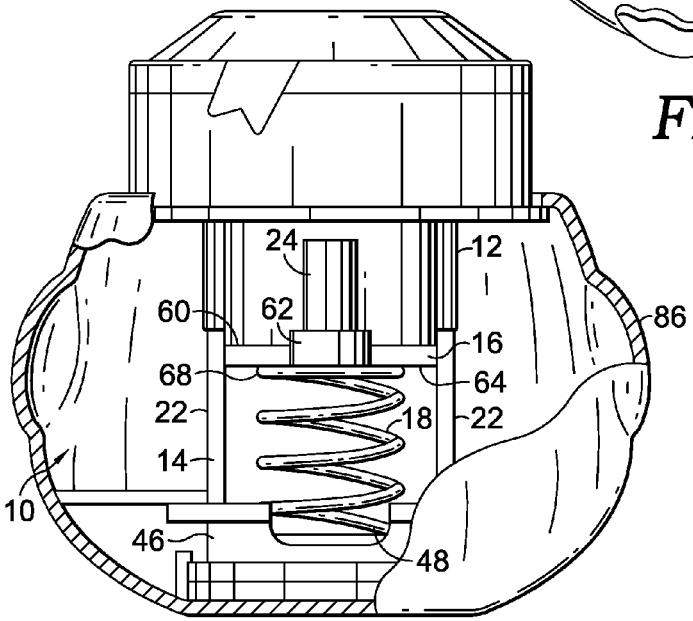
FIG. 3 is a cutaway view depicting a self-sealing stamping device in accordance with an embodiment of the invention.
Figure 4:
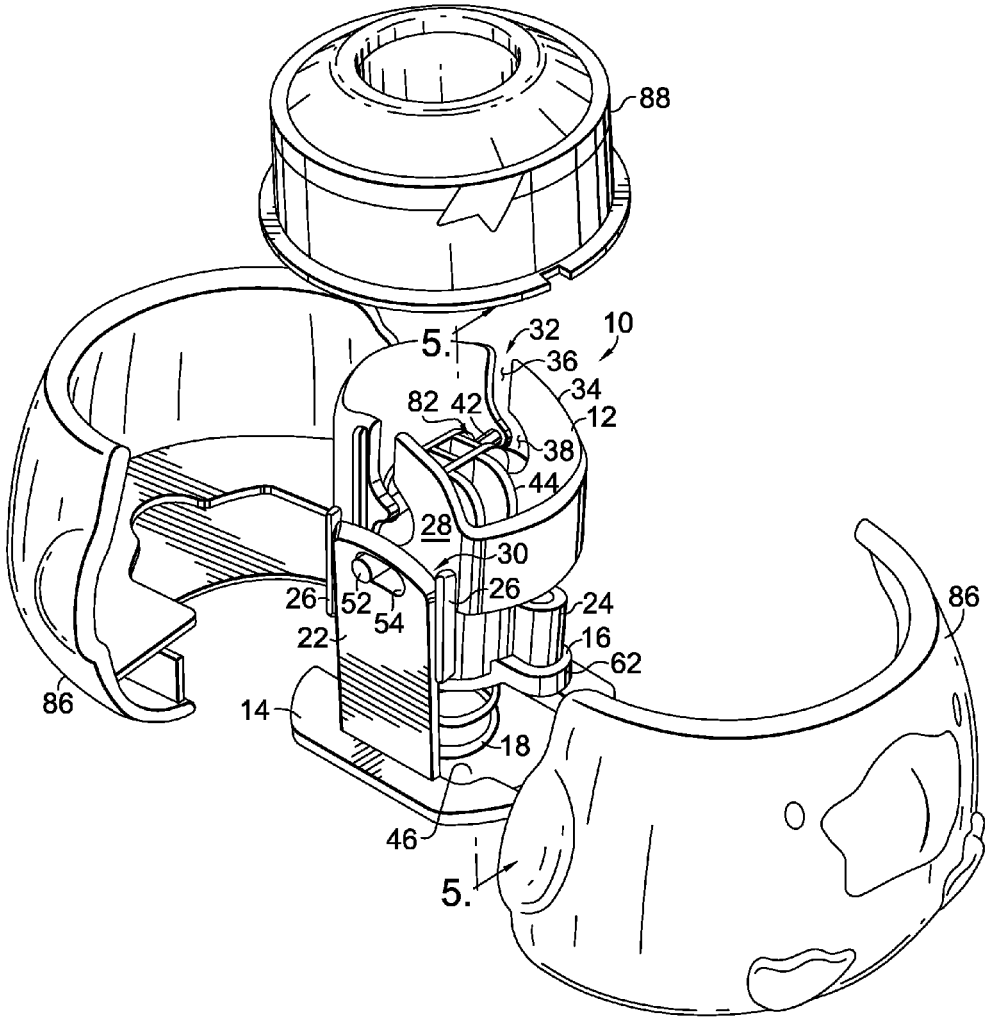
FIG. 4 is an exploded view depicting a self-sealing stamping device in accordance with an embodiment of the invention.
Figure 8:
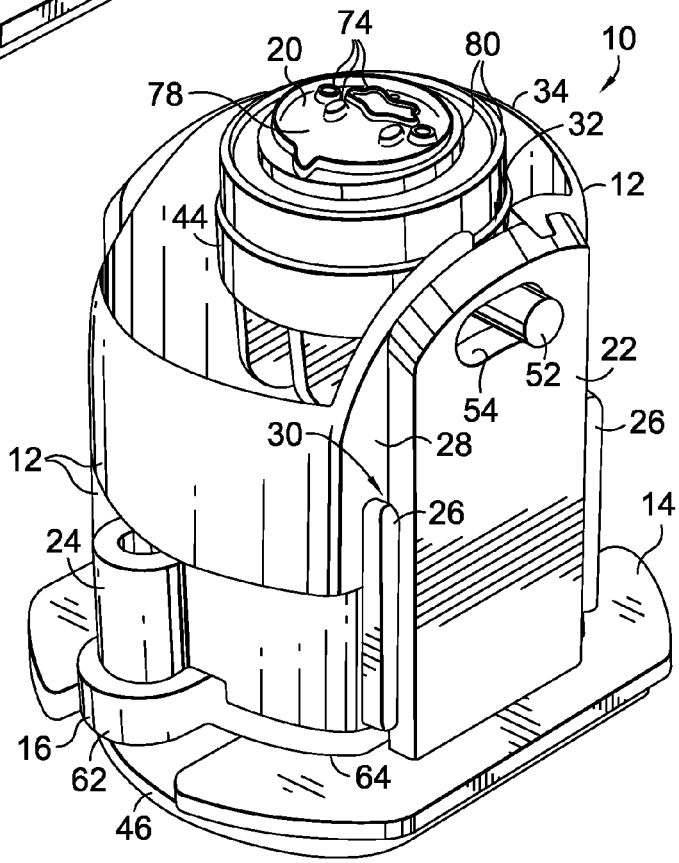
FIG. 8 is a perspective view depicting a self-sealing stamping device in a stamping position in accordance with an embodiment of the invention.
Figure 9:
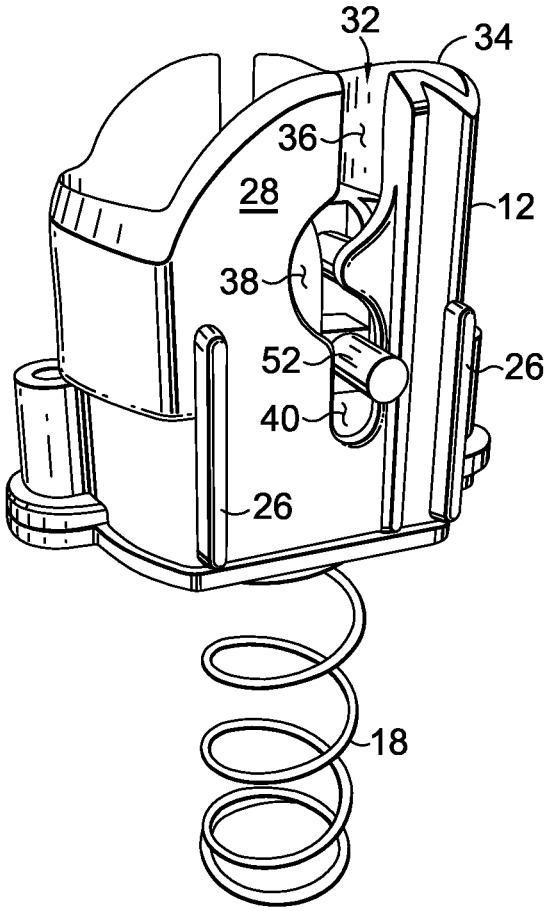
FIG. 9 is a perspective view depicting a self-sealing stamping device in a closed position in accordance with an embodiment of the invention.

The applicator 20, comprises an ink applicator having the one or more raised features 74 along a stamping surface 78 for accepting a layer or coating of ink and transferring said ink to a surface to be stamped (hereinafter referred to as a "marking surface"), such as for example, the surface of a piece of paper. The resulting transfer provides an ink representation of the raised features 74 of the stamping surface 78 on the marking surface. The raised features 74 of the stamping surface 78 may be carved or formed into the stamping surface 78 and may provide any desired design, such as for example a chick (baby chicken) character as depicted in FIGS. 2 and 8. The applicator 20 is constructed from any suitable material including, but not limited to, rubber, elastomeric compounds, foam, silicon, silicon based materials, composite materials, or plastic. In some embodiments, the applicator 20 may be made of a polyurethane material, such as a chitin-based polyurethane material.

The applicator 20 includes one or more sealing features 80 that function to seal the applicator 20 against the top surface 70 of the inkpad housing 16 when the stamping device 10 is in a closed position, as described below. The sealing features 80 may include ribs, surfaces, or protuberances that extend outwardly from the surface of the applicator 20 a distance less than that of the raised features 74 such that the sealing features do not transfer ink to a surface to be stamped. Additionally, or alternatively, the sealing features 80 may comprise channels, troughs, or other features extending into the surface of the applicator 20. Such sealing features 80 may accept or mate to sealing features 76 of the top surface 70 of the inkpad housing 16. In an embodiment, the perimeter of the raised features 74 functions as a sealing feature 80. In another embodiment, a raised rib extending around the perimeter of the raised features 74 or around the perimeter of the applicator 20 provides a sealing feature 80. In yet another embodiment, the surface of the applicator 20, other than that dedicated to the raised features 74, provides a sealing feature 80 by compressing against the top surface 70 of the inkpad housing 16 or against the sealing features 76 thereon.

The applicator 20 is mounted on the carrier 44. In an embodiment, the carrier 44 is integral to the applicator 20. Two pins 52 extend from opposite sides of the carrier 44 a distance sufficient to engage the slots 32 in the upper housing 12 and the apertures 54 of the actuator arms 22 when the stamping device 10 is assembled. A pair of channels 82 extends to a bottom surface 84 and away from the applicator 20 from a point just adjacent the pins 52. The channels 82 are configured to slideably accept the stationary pins 42 of the upper housing 12 therein. The pins and slots provide a mechanism by which the applicator 20 and carrier 44 are rotated from a closed position (shown in FIGS. 1 and 3-7) to a stamping position (shown in FIGS. 2 and 8) upon actuation of the stamping device 10. In an embodiment, a rack and pinion or a guide post mechanism is used to actuate the applicator 20 and carrier 44.

In operation, embodiments of the invention function to provide a sealed, airtight inkpad housing 16 while the stamping device 10 is in a closed position to increase the longevity of the inkpad 56 housed therein. In the closed position, as depicted in FIGS. 1 and 3-7, the spring 18 biases the upper and lower housings 12 and 14 away from one another such that the applicator 20 engages the one or more apertures 58 of the inkpad housing 16. As such, the raised features 74 of the applicator 20 are in contact with the inking surface 72 of the inkpad 56. The sealing features 80 of the applicator 20 and the sealing features 76 of the inkpad housing 16 are mated together to form an airtight seal between the applicator 20 and the inkpad housing 16. Thus, the inkpad 56 is encased within an airtight enclosure.

In an embodiment, the stamping device 10 is actuated by placing the upper end 34 of the upper housing 12 against a marking surface. A force is applied to the lower housing 14 thereby depressing the lower housing 14 toward the marking surface and compressing the spring 18. This likewise causes the applicator 20 to be withdrawn from the inkpad 56 by the interaction of the pins 52 of the carrier 44 and the apertures 54 of the actuator arms 22. The depression of the lower housing 14 causes the actuator arms 22 to slide toward the marking surface and thus slide the pins 52 along the second straight segment 40 of the slots 32 in the upper housing 12. Likewise, the motion also causes the stationary pins 42 to slide within the channels 82 of the carrier 44 from near the bottom surface 84 toward the applicator 20.

As the lower housing 14 is further depressed, the pins 52 engage the rotating segment 38 of the slot 32 and are translated laterally along the arced rotating segment 38 and within the elongated apertures 54 of the actuator arms. The lateral translation of the pins 52 cause the carrier 44 to rotate about the stationary pins 42 within the channels 82. Upon the pins 52 reaching the first straight segment 36 of the slot 32 the carrier is rotated generally about 180° from its original orientation.

Further depression of the lower housing 14 toward the marking surface translates the pins 52 along the first straight segment 36 of the slots 32 and toward the marking surface. The carrier 44 also slides along the stationary pins 42 via the channels 82. As such, the carrier 44 and the applicator 20 are suitably aligned to allow the raised features 74 of the applicator 20 to contact the marking surface. Further, depression of the lower housing 12 and translation of the pins 52 brings the raised features 74 into contact with the marking surface (e.g., the stamping position as depicted in FIGS. 2 and 8). In an embodiment, the movement of the carrier 44 and the applicator 20 are in a direction generally perpendicular to the marking surface.

Upon contacting the marking surface, the raised features 74 of the applicator 20 transfer an amount of ink from the surface of the raised features 74 to the marking surface as is known in the art. The force applied to the lower housing 14 is then released and the spring 18 provides a return force sufficient to withdraw the raised features 74 from the marking surface. The carrier 44 is rotated back to its original orientation following the reverse of the process described above. The raised features 74 are again placed in contact with the inking surface 72 of the inkpad 56 and the sealing features 80 and 76 of the applicator 20 and the inkpad housing 16 are again mated to provide an airtight enclosure for the inkpad 56.

While not in operation, the inkpad 56 remains sealed within the airtight chamber created by the inkpad housing 16, inkpad cover 70 and the applicator 20. When in operation, the inkpad 56 is exposed to the open atmosphere, but only for the short time required for the stamping device 10 to be actuated to the stamping position and then return to the closed position.

In an embodiment, the travel of the lower housing 14 is restricted such that the spring 18 remains at least partially in compression. Therefore, the compression forces of the spring create a compression force between the applicator 20 and the inkpad housing 16. Thereby, the integrity of the seal is increased. By creating an airtight seal between the applicator 20 and the inkpad housing 16, the useable lifespan of the inkpad 56 may be increased. In an embodiment, the airtight seal and enclosure of the inkpad housing 16 enable the use of inks that would otherwise evaporate or dry too quickly for use in the stamping device 10.

In an embodiment, the stamping surface 78 of the applicator 20 is a raised disc generally centrally located on an end surface of a cylindrically configured applicator 20. The raised features 74 are located on the raised disc of the stamping surface 78. The sealing features 80 include a flattened portion or trough 88 located radially outward from the stamping surface 78, as best depicted by FIGS. 5 and 6. A circular raised rib 90 is also located radially outward from the trough 88.

Similarly, the aperture 58 in the inkpad housing 16 is circular in shape and has dimensions suitable to accept the raised disc stamping surface 78 within the aperture 58. Around the aperture 58 are the sealing features 76 that include a first raised flange 91, a channel 92, and a second raised flange 94. As depicted in FIG. 6, the first raised flange 91 is configured to fit within the trough 96 of the applicator 20 and to contact one or more surfaces thereof when the stamping device is in the closed position. The channel 92 is located radially outward from the first raised flange 91 and is configured to accept the raised rib 90 of the applicator 20 when in the closed position. The second raised flange 94 is located radially outward from the channel 92 and is configured to accept the exterior perimeter of the applicator 20 therein. In an embodiment, each of the sealing features 80 and 76 are dimensioned to provide a generally snug or tight fit and one or more continuous contact surfaces so as to provide one or more airtight seals therebetween. In another embodiment, an airtight seal is also created between the sides of the aperture 58 and the raised disc stamping surface 78.

In another embodiment, the surface of the inkpad housing 16 facing the applicator 20 is coated with one or more materials such as, for example, rubber, plastic, enamel, or latex or includes one or more surface features such as ribs, or channels among others, to increase the tenacity of the seal.

The stamping device 10 may be employed as described above, or may be disposed within a larger housing. For example, the stamping device 10 may be contained within a generally egg-shaped body 86 providing ease of use and grasping by children as depicted in FIGS. 1-4. In such an embodiment, a decorative collar 88 is also affixed around the upper edge 34 of the upper housing 12.

It is understood that various methods are available in the art for actuating a stamping device, such as stamping device 10. It is contemplated that such methods are suitable for use in embodiments of the invention without departing from the scope thereof and are incorporated herein by reference. From the foregoing, it will be seen that this invention is one well adapted to attain all the ends and objects hereinabove set forth together with other advantages which are obvious and which are inherent to the structure. It will be understood that certain features and subcombinations are of utility and may be employed without reference to other features and subcombinations. This is contemplated by and is within the scope of the claims. Since many possible embodiments may be made of the invention without departing from the scope thereof, it is to be understood that all matter herein set forth or shown in the accompanying drawings is to be interpreted as illustrative and not in a limiting sense.

Having thus described the invention, what is claimed is:

1. A self-sealing stamping device comprising:

an applicator having one or more raised features on a stamping surface for transferring an ink to a marking surface, wherein the applicator includes a sealing feature around an exterior perimeter of the stamping surface;

an inkpad housing having an aperture with an interior perimeter operably configured to receive the stamping surface of the applicator, wherein the inkpad housing includes a sealing feature around the interior perimeter of the aperture, wherein an airtight seal is formed between the inkpad housing and the applicator when the stamping device is in a closed position based on mating the sealing feature around the exterior perimeter of the stamping surface with the sealing feature around the interior perimeter of the aperture of the inkpad housing, and further wherein at least a portion of one or more of the applicator and the inkpad housing comprises a chitin-based polyurethane material; and a mechanism for rotatably actuating the applicator from the closed position facing and contacting the inkpad housing to a stamping position facing and contacting the marking surface.

2. The self-sealing stamping device of claim 1, wherein at least a portion of the sealing feature around the perimeter of the stamping surface comprises a chitin-based polyurethane material.

3. The self-sealing stamping device of claim 1, wherein the sealing features are one or more of a rib, a flange, a trough, and a channel.

4. The self-sealing stamping device of claim 1, wherein the mechanism for rotatably actuating the applicator further comprises:

an upper housing that includes a hollow enclosure having two opposing open ends, a pair of open-ended slots extending from a top edge toward a bottom edge along a portion of the length of the upper housing, and a pair of stationary pins, each of the stationary pins located on an opposing interior surface of the upper housing, wherein the inkpad housing is attached along the bottom edge of the upper housing;

a lower housing that includes a base portion and a pair of actuating arms, the actuating arms extending generally perpendicularly to the base portion and parallel to one another from opposite sides of the base portion;

a spring disposed between the base portion of the lower housing and the inkpad housing;

a carrier that includes a pair of channels for accepting the stationary pins and a pair of carrier pins extending from opposite sides of the carrier, the applicator affixed to a first end of the carrier.

5. The self-sealing stamping device of claim 4, wherein the pair of open-ended slots in the upper housing include a first straight segment, a second straight segment, and an arched rotating segment therebetween.

6. The self-sealing stamping device of claim 4, wherein depression of the lower housing toward the upper housing causes the applicator to be withdrawn from the aperture and from sealing contact with the inkpad housing, rotation of the carrier and applicator approximately 180 degrees, and movement of the applicator to a stamping position, wherein the raised features on the stamping surface of the applicator contact the marking surface.

7. The self-sealing stamping device of claim 1, wherein an inkpad is disposed in the inkpad housing and the inkpad is one or more of a cloth pad, a foam pad, a cloth pad with an associated ink reservoir, and a foam pad with an ink reservoir.

8. The self-sealing stamping device of claim 1, wherein the inkpad is at least partially wetted with an ink that is one or more of non-toxic, washable, water-based, and alcohol-based.

9. A method for providing a self-sealing stamping device, the method comprising:

providing an applicator having one or more raised features on a stamping surface;

providing an inkpad housing having an ink source disposed therein, the inkpad housing having an aperture suitable for accepting the stamping surface of the applicator, wherein an airtight seal is formed between contacting surfaces of the inkpad housing and the applicator when the stamping device is in a closed position, wherein a sealing feature on an exterior perimeter of the stamping surface of the applicator and a sealing feature on an interior perimeter of the aperture in the inkpad housing are configured to mate together when the stamping device is in the closed position, wherein at least a portion of one or more of the inkpad housing and the applicator comprises a chitin-based polyurethane material;

inserting the stamping surface of the applicator into the aperture of the inkpad housing, wherein the raised features on the stamping surface contact the ink source; and contacting the inkpad housing with the applicator to form an airtight seal between the applicator and the inkpad housing.

10. The method of claim 9, further comprising:

withdrawing the stamping surface of the applicator from within the aperture of the inkpad housing;

rotating the applicator from a position facing the inkpad housing to a position facing a marking surface;

contacting the marking surface with the raised features;

withdrawing the raised features from the marking surface;

rotating the applicator from the position facing the marking surface to the position facing the inkpad housing;

reinserting the stamping surface into the aperture; and contacting the inkpad housing with the applicator to again create an airtight seal between the applicator and the inkpad housing.

11. The method of claim 10, further comprising:

placing a first end of the stamping device in contact with the marking surface;

applying a force to a second end of the stamping device to depress the second end toward the marking surface and move the stamping device from the closed position to a stamping position; and removing the force to allow a spring in the stamping device to return the stamping device to the closed position.

12. The method of claim 9, wherein contacting the inkpad housing with the applicator to form an airtight seal between the applicator and the inkpad housing further comprises:

at least partially compressing one or more of the inkpad housing and the applicator.

13. The method of claim 9, wherein the ink source includes one or more of non-toxic, washable, water-based, and alcohol-based ink.

14. The method of claim 9, wherein one or more of the applicator and the inkpad housing include a sealing feature comprising one or more of a rib, a flange, a trough, and a channel.

15. The method of claim 14, wherein at least a portion of one or more of the sealing features of the applicator and the inkpad housing comprises a chitin-based polyurethane material.

16. The method of claim 9, wherein an airtight seal is formed between an exterior perimeter of the stamping surface and an interior perimeter of the aperture in the inkpad housing.

17. A self-sealing stamping device comprising:

an applicator having one or more raised features on a stamping surface for transferring an ink to a marking surface and a sealing feature around an exterior perimeter of the stamping surface that includes one or more of a rib, a flange, a trough, and a channel;

an inkpad housing having an aperture with an interior perimeter operably configured to receive the stamping surface of the applicator, and a sealing feature around the interior perimeter of the aperture comprising one or more of a rib, a flange, a trough, and a channel, wherein an airtight seal is formed between mating sealing features of the inkpad housing and the applicator when the stamping device is in a closed position, wherein at least a portion of one or more of the applicator and the inkpad housing comprises a chitin-based polyurethane material;

an ink source disposed within the inkpad housing comprising one or more of a cloth pad, a foam pad, a cloth pad with an associated ink reservoir, and a foam pad with an associated ink reservoir, the ink source containing an ink that is one or more of non-toxic, washable, water-based, and alcohol-based; and a mechanism for rotatably actuating the applicator from the closed position facing and contacting the inkpad housing to a stamping position facing and contacting the marking surface.

18. The self-sealing stamping device of claim 17, wherein the sealing feature around the exterior perimeter of the stamping surface comprises a chitin-based polyurethane material.

19. The self-sealing stamping device of claim 17, wherein the sealing feature around the interior perimeter of the aperture of the inkpad housing comprises a chitin-based polyurethane material.

* * * * *